US005440912A

United States Patent [19]

Copeman

[11] Patent Number: 5,440,912

[45] Date of Patent: Aug. 15, 1995

[54] FORM AND PUNCH APPARATUS

[75] Inventor: David G. Copeman, Sterling Heights, Mich.

[73] Assignee: Savair Inc., St. Clair Shores, Mich.

[21] Appl. No.: 162,711

[22] Filed: Dec. 6, 1993

[51] Int. Cl.[6] ..... B21D 28/20

[52] U.S. Cl. ..... 72/334; 72/407; 72/453.01

[58] Field of Search ..... 72/407, 334, 335, 453.01, 72/453.02

[56] References Cited

U.S. PATENT DOCUMENTS

| | | | |
|---|---|---|---|
| Re. 33,798 | 1/1992 | Waltonen . | |
| 300,174 | 6/1884 | Webster | 72/407 |
| 1,875,448 | 9/1932 | Hanna | 72/407 |
| 3,270,604 | 9/1966 | Waltonen . | |
| 3,311,049 | 3/1967 | Hugi . | |
| 3,722,337 | 3/1973 | Brolund et al. . | |
| 3,777,601 | 12/1973 | Strandell . | |
| 4,098,161 | 7/1978 | Bloch . | |
| 4,549,457 | 10/1985 | Bloch et al. . | |
| 4,621,512 | 11/1986 | Tachikawa et al. . | |
| 4,684,778 | 8/1987 | Cecil . | |
| 4,706,489 | 11/1987 | Dacey, Jr. . | |
| 4,716,803 | 1/1988 | Waltonen . | |
| 4,760,633 | 8/1988 | Dacey, Jr. . | |
| 4,763,550 | 8/1988 | Waltonen et al. . | |
| 4,813,125 | 3/1989 | Dacey, Jr. . | |
| 4,861,959 | 8/1989 | Cecil . | |
| 4,884,431 | 12/1989 | Dacey, Jr. . | |
| 4,916,932 | 4/1990 | Obrecht et al. . | |
| 4,928,388 | 5/1990 | Dacey, Jr. . | |
| 4,932,128 | 6/1990 | Dacey, Jr. . | |
| 4,934,226 | 6/1990 | Dacey, Jr. . | |
| 4,959,989 | 10/1990 | Obrecht et al. . | |
| 4,976,026 | 12/1990 | Dacey, Jr. . | |
| 4,993,295 | 2/1991 | Dacey, Jr. . | |
| 4,998,332 | 3/1991 | Dacey, Jr. . | |
| 5,027,909 | 7/1991 | Carter et al. . | |
| 5,033,555 | 7/1991 | Carter et al. . | |
| 5,054,305 | 10/1991 | Obrecht et al. . | |
| 5,072,506 | 12/1991 | Dacey, Jr. . | |
| 5,076,090 | 12/1991 | Cetnarowski . | |
| 5,083,355 | 1/1992 | Dacey, Jr. . | |
| 5,095,618 | 3/1992 | Dacey, Jr. . | |
| 5,174,489 | 12/1992 | Mason . | |
| 5,215,414 | 6/1993 | Roseliep . | |

FOREIGN PATENT DOCUMENTS

| | | | |
|---|---|---|---|
| 220240 | 9/1987 | Japan | 72/407 |
| 286201 | 11/1988 | Japan | 72/407 |

*Primary Examiner*—Daniel C. Crane
*Attorney, Agent, or Firm*—Merchant, Gould, Smith, Edell, Welter & Schmidt

[57] ABSTRACT

An apparatus is provided to form a workpiece to a net position and pierce a hole in the workpiece. The apparatus includes a base having an inner and outer slide assembly mounted thereon for reciprocal movement. Both the inner and outer slides include a cylinder and a rod extending therefrom. The apparatus includes a compressed spring attached between the inner slide and base, and coupled to the rod of the outer slide as to operate to equalize the inner slide about the workpiece. The rod of the outer slide impacts the base to drive a form against the workpiece to form the workpiece to a net position. The rod of the inner slide actuates to drive a punch through the workpiece to pierce the workpiece.

18 Claims, 6 Drawing Sheets

FORM AND PUNCH APPARATUS

TECHNICAL FIELD

The present invention relates to an apparatus for performing mechanical operations on a workpiece. Specifically, the invention relates to an apparatus operable in forming a workpiece to a net position and piercing the workpiece.

BACKGROUND OF THE INVENTION

Piercing and forming are common to many industrial fabrication processes. Often, it is necessary to form or emboss a workpiece to a net position. A net position is achieved when, regardless of the placement of the workpiece relative to the tooling, the workpiece is embossed to the same position relative to the base, or some other constant position. Embossing a workpiece to a net position is important when aligning a number of internal support members together which will subsequently have external panels mounted thereon.

For example, often times the workpiece to be embossed is associated with a frame. The frame includes many attached parts. These parts may not always be flush or properly aligned. In the prior art, pads are drawn out from the various parts, and panels are mounted on the pads. However, the prior art provides for drawing the metal out a set distance, i.e. one-half inch. If one-half inch pads are drawn out uniformly from misaligned pieces, the pads will also be misaligned as well as the subsequently attached panels.

Additionally, many devices of the prior art provide for equalization about a workpiece. Equalization describes the process by which a tool is brought up to the workpiece and stopped at contact. Equalization of the tooling about the workpiece prevents unnecessary damage to the workpiece prior to forming. Equalization in the prior art has been accomplished through a variety of mechanisms, including springs and hydraulic cylinders. Two mechanism of equalization are described in U.S. Pat. No. 3,008,032, to Wolfbauer et al, and U.S. Pat. No. 3,396,260 to Waltonen.

Besides providing a device to form a workpiece it is often advantageous to provide a device operable in forming and piecing a workpiece. Such dual function apparatus provide efficient utilization of machinery by eliminating the need for additional equipment. Additionally, such dual function machinery in the prior art is large and cumbersome to use.

For example, U.S. Pat. No. 5,054,305 to Obrecht et al. discloses a multiple function hydraulic apparatus comprising an upper and a lower slide assembly which operate to reciprocally move in an equalized fashion. The device includes four cylinders: the first cylinder equalizes the device about a workpiece; the second cylinder operates to form the workpiece; the third cylinder operates to pierce the workpiece; and the fourth cylinder drives a wedge into a hole to lock half of the forming mechanism against the workpiece. The Obrecht device is extremely bulky and cumbersome due to the numerous cylinders and their varying orientation.

Therefore, there is a need to provide a more compact mechanism capable of forming a workpiece to a net position and piercing the workpiece. The present invention solves these and other problems of the prior art.

SUMMARY OF THE INVENTION

The present invention includes an apparatus operable in forming a workpiece to a net position. The invention includes a base having an inner and an outer slide assembly mounted thereon for reciprocal movement. The inner slide assembly includes a form back-up. The apparatus also includes a means for equalizing the form back-up against the workpiece. The outer slide assembly includes a form cylinder having a rod extending towards the base. The outer slide assembly also includes a yoke having a distal end and a proximal end. The proximal end is attached to the form cylinder and the distal end is attached to a die block. When the rod extends a predetermined amount from the cylinder and contacts the base, the die block moves toward the workpiece and forms the workpiece.

A slave cylinder may also be included having a slave rod extending therefrom. The slave cylinder is mounted to the base, and the slave rod is connected to the inner slide assembly. The slave cylinder is fillable through a one way valve so that when the form back-up of the inner slide assembly contacts the workpiece the slave cylinder locks the form back-up against the workpiece.

The inner slide assembly also may include a pierce cylinder having a pierce rod extending therefrom. The pierce rod includes a punch that is operable in piercing a hole through the workpiece after it has been formed.

DETAILED DESCRIPTION OF THE PREFERRED EMBODIMENT

Figure 1:
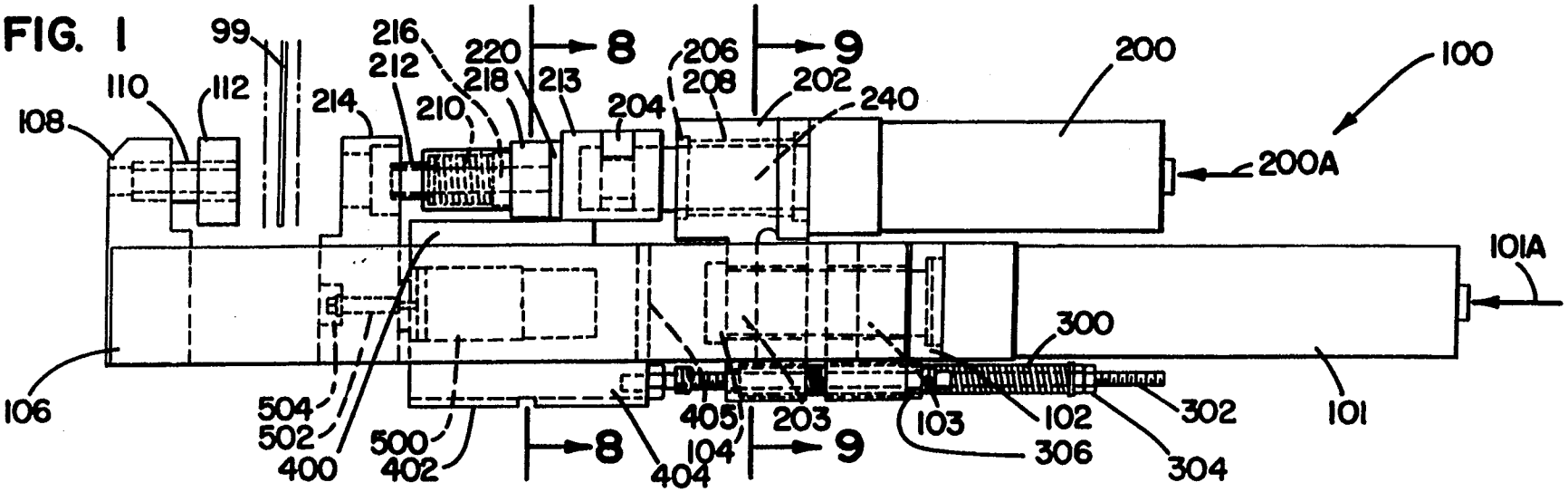
FIG. 1 is a side view of one embodiment of an apparatus according to the present invention in its open position.

Generally the present invention operates to equalize a form die and a form back-up about a workpiece, form or emboss the workpiece to a net position, and pierce a hole through the workpiece. The invention generally includes an inner and an outer slide assembly. The outer slide assembly includes a form cylinder slidably mounted to a base, the form cylinder has a form punch mounted thereon via a pair of outer slide rails. The inner slide assembly includes a pierce cylinder, including a form back-up and is coupled to a form cylinder rod end via a cylinder mounting block extension.

The workpiece is positioned between the form back-up of the inner slide assembly and the form of the outer slide assembly. A compressed coiled spring forces the cylinder mounting block extension against the form cylinder rod end. When the form cylinder is actuated, the compressed energy in the spring compels the cylinder mounting block extension along with the entire inner slide assembly towards the workpiece. The spring has enough energy to move the inner slide assembly until the form back-up contacts the workpiece, at which time the inner slide assembly stops.

A slave cylinder is also included, the rod of which is drawn out through a one-way pilot valve as the inner slide assembly moves towards the workpiece. The slave cylinder mounts to a base block and a rod of the slave cylinder operably attaches to the inner slide assembly. As the inner slide assembly moves toward the workpiece the form back-up operates to pull the slave rod away from the slave cylinder, thus filling the slave cylinder through the one, way pilot valve. The one-way valve of the slave cylinder operates to maintain the entire inner slide assembly in a fixed position against the workpiece when the workpiece is embossed.

The form cylinder rod end continues to extend until it impacts the base block. The form cylinder continues to push the form cylinder rod end against the base block, thus moving a form punch and an anvil, as connected via the outer slide rails, towards the workpiece. The form cylinder extends a predetermined amount to emboss the workpiece to a net position.

After the workpiece has been embossed, a pierce cylinder of the inner slide assembly actuates a punch to pierce a hole in the workpiece.

The invention also includes a pair of strippers, each stripper being associated with the form punch or the pierce punch, respectively. The strippers operate to firmly hold the workpiece while the form punch and pierce punch are withdrawn.

The rod end of the form cylinder then disengages from the base block and engages the cylinder mounting block extension of the inner slide assembly. The one-way pilot valve is also opened. The form cylinder pulls back the cylinder mounting block extension, thus compressing the equalization spring. The hydraulic fluid in the slave cylinder is also expelled.

The form cylinder retracts until a stop shaft contacts a rest button to position the anvil of the outer slide assembly a set distance away from the form back-up.

Referring now to the drawings in which like elements are numbered alike, and in particular to FIG. 1, there is shown a side view of a form and punch 100 in its open position. The present invention includes an outer slide assembly 101A and an inner slide assembly 200A. Outer slide assembly 101A includes an emboss or form punch 110 positioned adjacent a workpiece 99 while the inner slide assembly 200A includes a form back-up 214 positioned adjacent workpiece 99 and a pierce punch 216.

Figure 7:
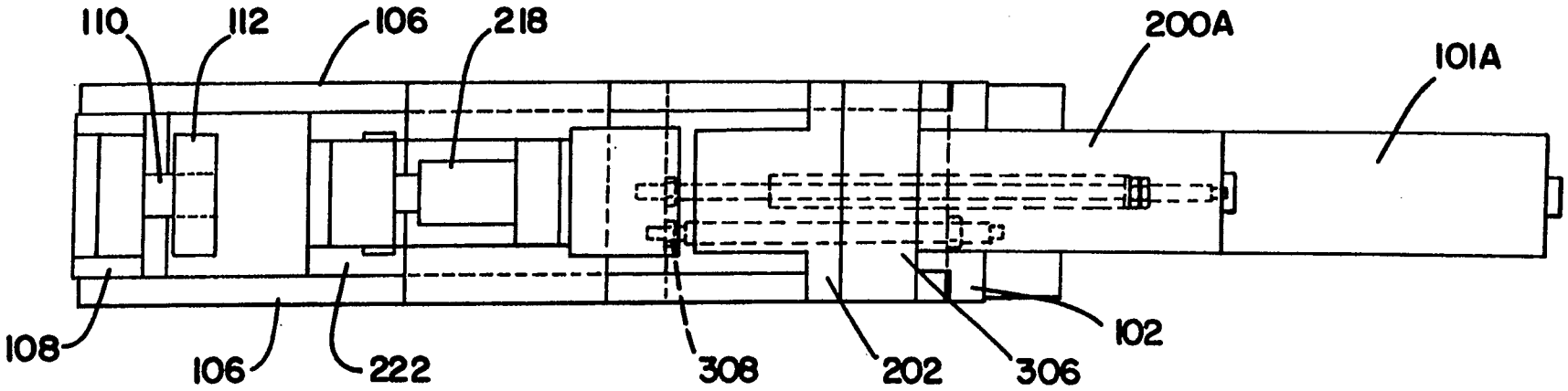
FIG. 7 is a top plan view of the apparatus in the open position.

The outer slide assembly 101A preferably includes a form cylinder 101. Form cylinder 101 is a hydraulically actuated cylinder. Outer slide assembly 101A is slidably mounted to a base block 404 for reciprocal movement via a form cylinder mounting block 102, as best seen in FIGS. 1 and 7.

Referring to FIGS. 1–6, form cylinder 101 includes a form rod 103 having a bullet-like rod end or head 104 which operates to extend towards base block 404. Preferably, a hardened metallic plate 405 is mounted to base block 404 proximate bullet head 104. A pair of outer slide rails 106 form a yoke which connect form cylinder 101 to an anvil 108. Anvil 108 operates to position a form punch 110 and, a stripper 112 slidably connected to form punch 110, adjacent a workpiece 99.

Workpiece 99 could be any arrangement composed of formed sheet metal shapes fashioned to form an assembly. An outer shell or panel will then be mounted to the assembly through the used of screws, adhesives, or any other suitable fastener. For example, in the automotive industry, a auto-body inner frame might be a door, hood, deck lid, radiator support or cowl assembly. Additionally, household appliances including refrigerators, washers, and dryers, among others, also include inner assemblies.

Figure 9:
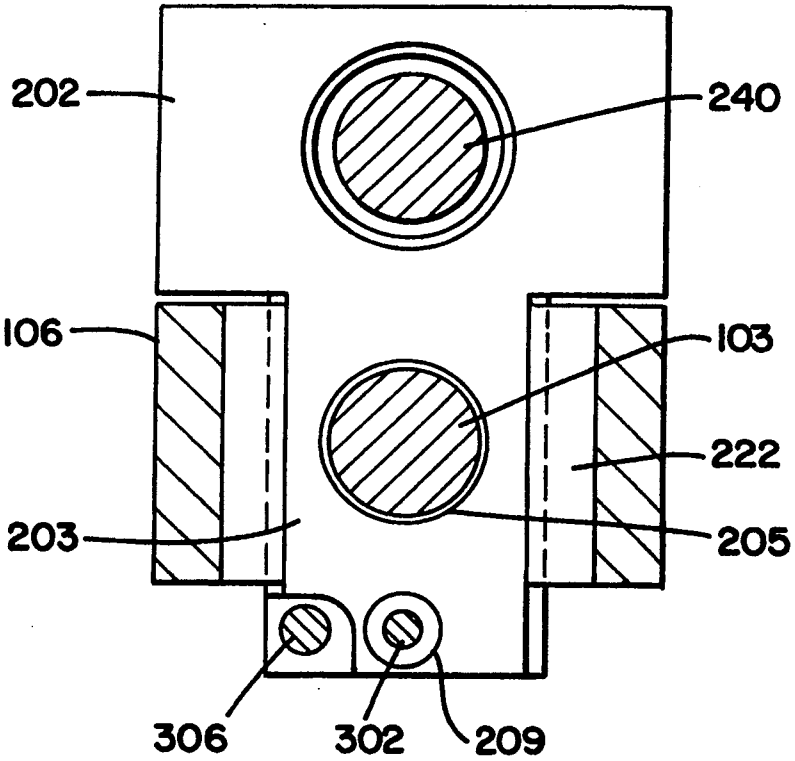
FIG. 9 is a cross sectional view of a portion of the apparatus taken along the line 9—9.

Inner slide assembly 200A preferably includes a pierce cylinder 200 slidably mounted to base block 404. Pierce Cylinder 200 includes a pierce cylinder rod 240 having a distal end 213. Inner slide assembly 200A also includes a pierce cylinder mount 202 with a pierce cylinder mount block extension 203 extending therefrom through outer slide assembly 101A. Cylinder block extension 203 includes a pair of apertures 205 and 209 as best seen in FIG. 9. Upper aperture 205 slidably receives form cylinder rod 103 therein and captures its bullet head 104. The outer aperture 209 has the end of a coiled spring 300 mounted therein. Bullet head 104 and aperture 205 of cylinder block extension 203, in conjunction with a spring 300 allows inner slide assembly 200A to equalize about workpiece 99.

It is to be understood that other mechanisms may be provided to equalize inner slide assembly about workpiece 99. For example, arrangements which utilize additional hydraulic cylinders, without the need for springs may also be used to equalize form back-up 214 against workpiece 99.

The form and punch apparatus of the present invention equalizes form back-up 214 against workpiece 99 prior to form punch 110 embossing workpiece 99. Preferably, equalization is accomplished with spring 300 attached between base block 404 and pierce mounting block extension 203.

Extending from base block 404 is a spring guide 302. Spring guide includes a plurality of threaded fasteners attached at one end maintaining one end of an equalization spring 300. Equalization spring 300 is locked in place at its other end at aperture 209 of pierce cylinder mounting block extension 203. When form rod 103 extends toward base block 404, equalization spring 300 compels inner slide assembly 200A towards workpiece 99 as seen in FIGS. 1–6. When form back-up 214 contacts workpiece 99, equalization spring 300 no longer has enough stored energy to move inner slide assembly 200A.

A slave cylinder 500 operates to rigidly hold form back-up 214 against workpiece 99. Slave cylinder 500 is placed within base plate 404. Slave cylinder 500 includes a slave rod 502. Slave cylinder 500 may be integrally formed within base block 404 or may be separately constructed and attached to base block 404.

Figure 10:
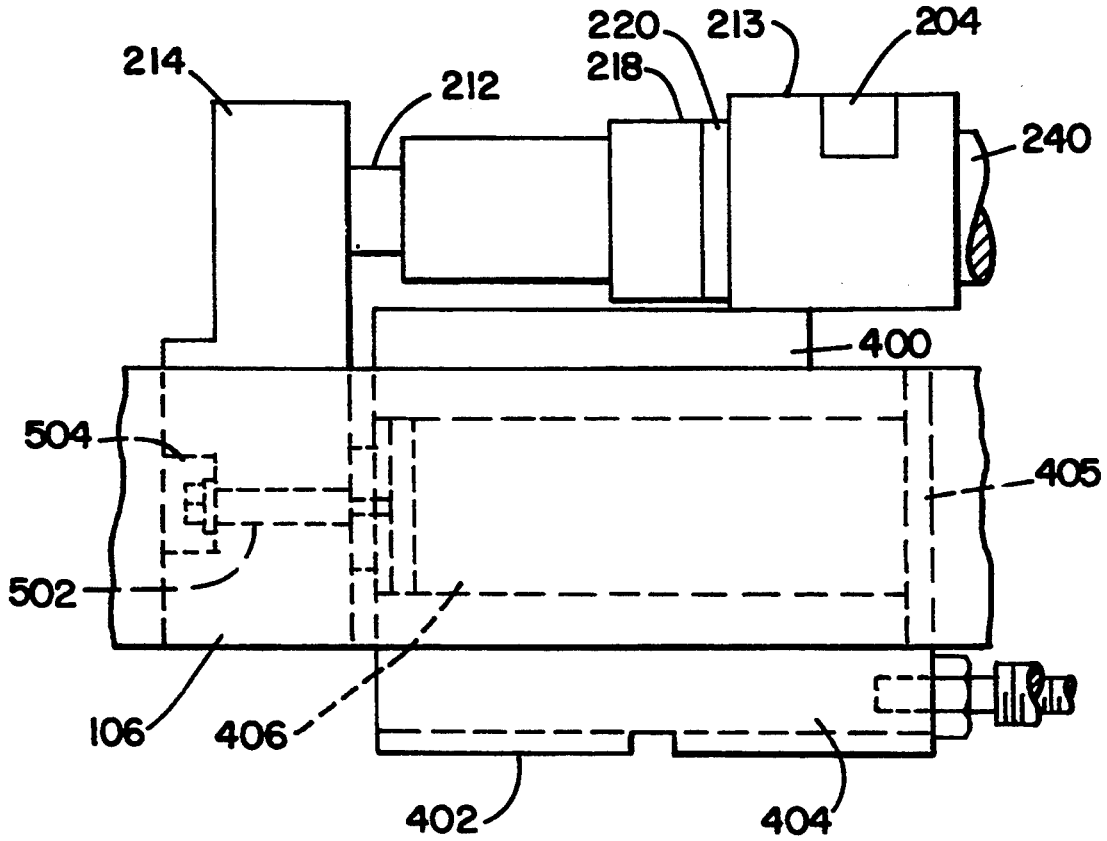
FIG. 10 is an exploded view of an alternative embodiment of the base block and slave cylinder of the present invention.

Referring to FIG. 10, an aperture 406 may be cut into base block 404. A separately constructed slave cylinder 500 may then be inserted into aperture 406 and bolted to hardened plate 405. The various possible placements of slave cylinder 500 fit particular applications which dictate the exact placement.

Form cylinders of different strokes can be utilized to increase or decrease the distance between the form back-up 214 and workpiece 99 to accommodate specific applications. Additionally, slave cylinders of longer stroke may be also be utilized. Slave cylinders longer stroke are difficult to integrally form within the base block, and therefore a separately constructed slave cylinder may be constructed and attached to the base block.

Figure 2:
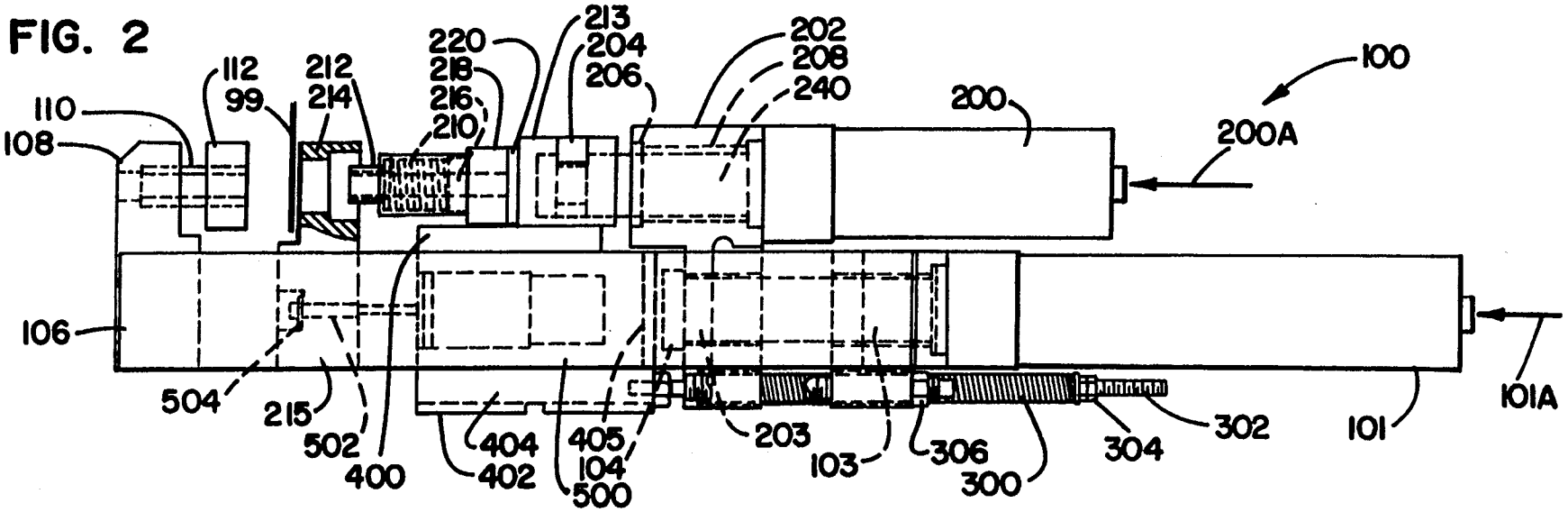
FIG. 2 is a side view of the apparatus with the form back-up equalizing about the workpiece.
Figure 3:
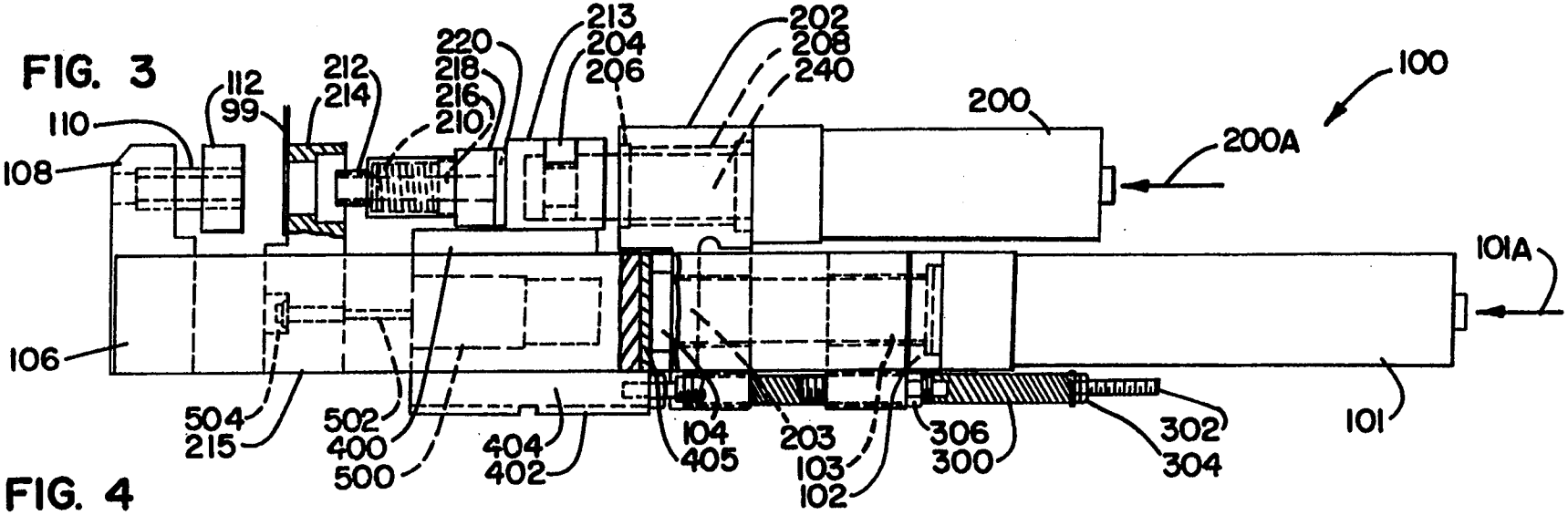
FIG. 3 is a side view of the apparatus with the form back-up locked against the workpiece with the slave cylinder.

Specifically, slave rod 502 is mounted to extension 215 by mount 504 of form back-up 214, as best shown in FIGS. 2 and 3. When equalization spring 300 pushes inner slide assembly 200A towards workpiece 99, extension 215 of form back-up 214 draws rod 502 out of slave cylinder 500 thus filling slave cylinder 500 through a one-way pilot valve (not shown). Slave cylinder 500 and one way valve (not shown) rigidly hold form back-up 214 against workpiece 99 during operation.

Other mechanisms may be provided to hold form back-up 214 against workpiece 99. For example, a wedge could be inserted into a pocket or hole which would open when form back-up 214 contacted workpiece 99. However, due to the inherent flexibility provided through the use of a slave cylinder and a one-way valve, it is preferred.

A stop shaft 306 is positioned parallel to spring guide 302 as best seen in FIG. 9. Stop shaft 306 operates to adjust the width, or opening, between form punch 110 and workpiece 99. Stop shaft 306 is adjustably received within form cylinder mounting block 102. Stop shaft 306 contacts a rest button 308 fixed into base block 404 as best seen in FIG. 7. Stop shaft may be rotated in a clockwise direction to increase the distance between form mounting block 102 and base block 404. Increasing the distance between form mounting block 102 and base block 404 increases the distance between form back-up 214 and work piece 99 proportionately.

It is to be understood that in the preferred embodiment of the invention, the distance between form back-up 214 and form punch 110 is a function of the stroke of the form cylinder and the pierce cylinder. Stop shaft 306 adjusts the position of the opening between form back-up 214 and form punch 110. Different arrangements are also contemplated.

The distance between the form punch and form back-up might be adjusted to accommodate different types of workpieces. For example, a workpiece may include a pre-formed reinforcement bead or flange, not shown. Depending on the location of the pre-formed bead or flange form punch 110 or form back-up 214 may be required to travel more or less before contact is made with the workpiece.

Figure 8:
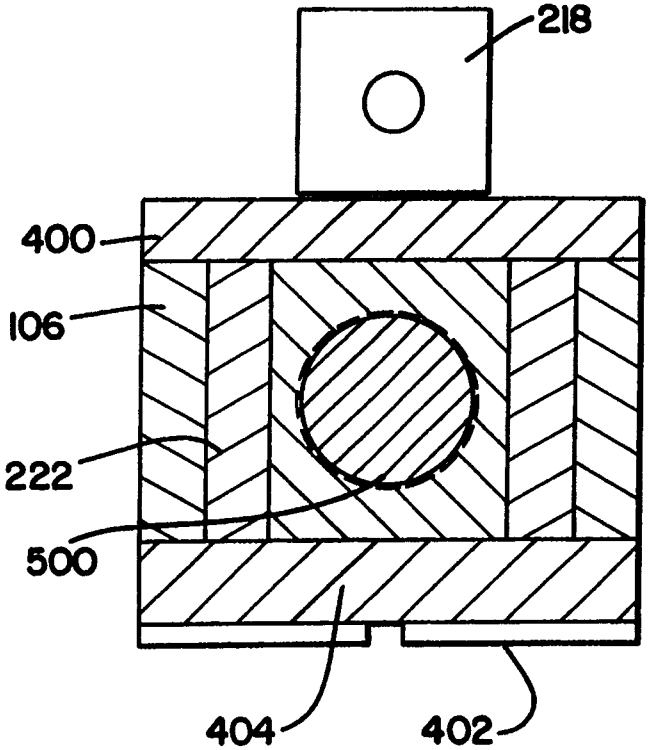
FIG. 8 is a cross sectional view of a portion of the apparatus taken along the line 8—8.

Form back-up 214 includes an extension 215. A pair of inner slide rails 222 are attached between pierce cylinder mount extension 203 and extension 215. Inner slide rails 222 are further positioned between base block 404 and outer slide rails 106 as best seen in FIG. 8.

A gib plate 400 is positioned below distal end 213, of pierce cylinder rod 240, and gib plate 400 mounts to base block 404 as best seen in FIG. 2. Gib plate 400 allows inner slide assembly 200A and outer slide assembly 101A to be positioned in a uniform spaced relation.

Pierce cylinder rod 240 extends from pierce cylinder 200 through a bearing 208 and a seal 206. Distal end 213 of pierce cylinder rod 240 is attached to pierce cylinder rod 240 by a key 204. Key 204 is followed by a back plate 220. In the preferred embodiment, a punch retainer 218 and back plate 220 mount to distal end 213 to retain pierce punch 216.

When pierce cylinder 200 activates, pierce rod 240 extends thus forcing pierce punch 216 through form back-up 214 to pierce a hole in workpiece 99. A stripper is also attached to retainer 218 to aid in clamping workpiece 99 to form punch 110 when pierce punch 216 is withdrawn from workpiece 99. A metal slug, not shown, is then removed from form punch 110 so that excess metal will not obstruct later operations.

Variations of the above construction are possible. In the preferred embodiment cylinders 101 and 200 are hydraulic, but in light industrial applications the cylinders may be pneumatic. Additionally it should be understood that the exact configuration of the inner and outer slide assemblies is not necessarily a feature of the claimed invention.

OPERATION

A sequence of operation for the present invention is shown in FIGS. 1–6. FIG. 1 illustrates form and punch 100 in its open position. As disclosed above, the distance between form back-up 214 and workpiece 99 may be adjusted through adjustment of stop shaft 306. Pressure applied to form cylinder 101 moves bullet head 104 of form cylinder 101 towards base block 404.

As bullet head 104 moves towards metallic plate 405 of base block 404, equalization spring 300, which is permanently affixed to spring guide 302 at one end and pierce cylinder mounting block extension 203 at its other end, causes pierce cylinder mounting block 202 as well as the entire inner slide assembly 200A to follow bullet head 104. Movement of bullet head 104 causes inner slide rails 222 to slide against the outer slide rails 106. The edges of inner slide rails also slide against gib plate 400.

As stated earlier, the process of moving the inner slide assembly 200A, including form back-up 214, towards workpiece 99 is generally referred to as equalization. Specifically, the stored energy in compressed spring 300 forces cylinder mounting block extension 203, along with inner slide assembly 200A, to follow bullet head 104 of rod 103. Compressed spring 300 moves inner slide assembly 200A until form back-up 214 contacts workpiece 99, as best shown in FIGS. 1 through 3.

As inner slide assembly 200A moves toward workpiece 99, through the force exerted by equalization spring 300, form back-up extension 215 operates to draw slave rod 502 out of slave cylinder 500, which is affixed to base block 404. When form back-up 214 contacts workpiece 99, slave rod 502 no longer is drawn out of slave cylinder 500 and inner slide assembly 200A, including form back-up 214 are locked in place against workpiece 99 through the one way valve (not shown) associated with slave cylinder 500. Inner slide assembly 200A cannot be forced back as the one-way valve (not shown) will not allow fluid to exit from the slave cylinder 500. It is only after the process is completed that the one-way valve is opened and fluid from slave cylinder 500 is expelled.

As shown in FIG. 3, after form back-up 214 contacts workpiece 99, bullet head 104 disengages and separates from pierce cylinder mounting block extension 215. Bullet head 104 continues to extend toward metallic plate 405 of base block 404.

Figure 4:
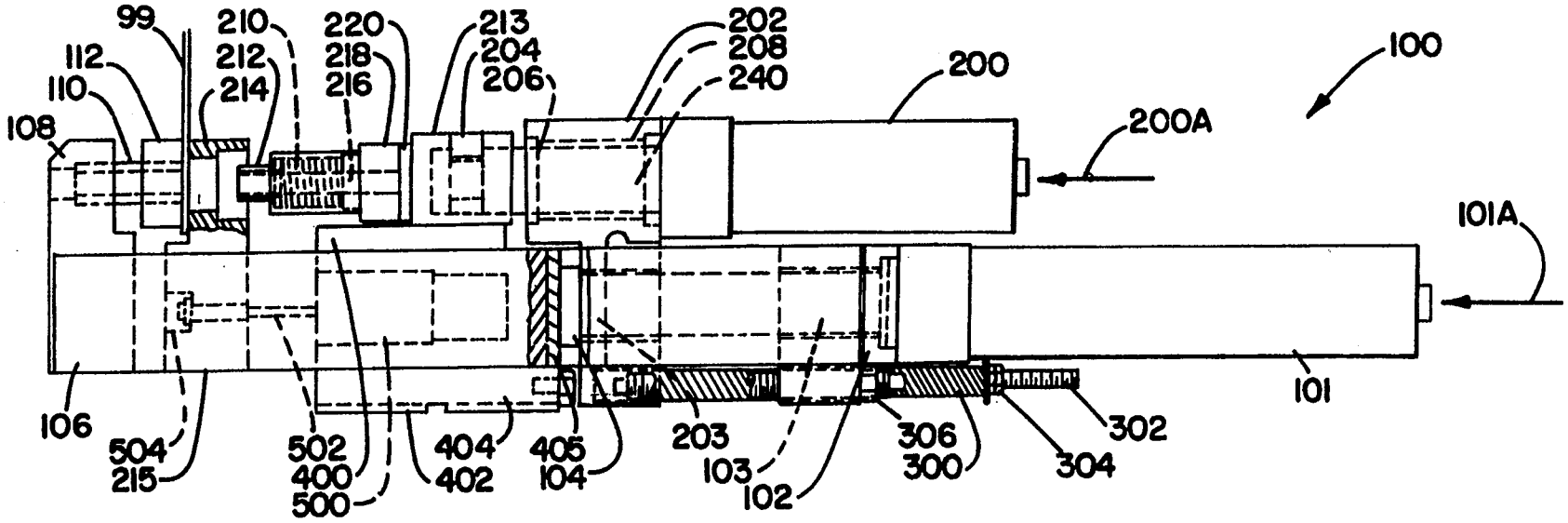
FIG. 4 is a side view of the apparatus with the form contacting the workpiece.

As best seen in FIG. 4, form cylinder rod 103 and form cylinder 101 push off base block 404 to move form cylinder to the right as shown in FIG. 4. Because form cylinder mounting block 102 is rigidly connected to anvil 108 by outer slide rails 106, anvil 108 including form punch 110 and stripper 112 move towards workpiece 99.

Figure 5:
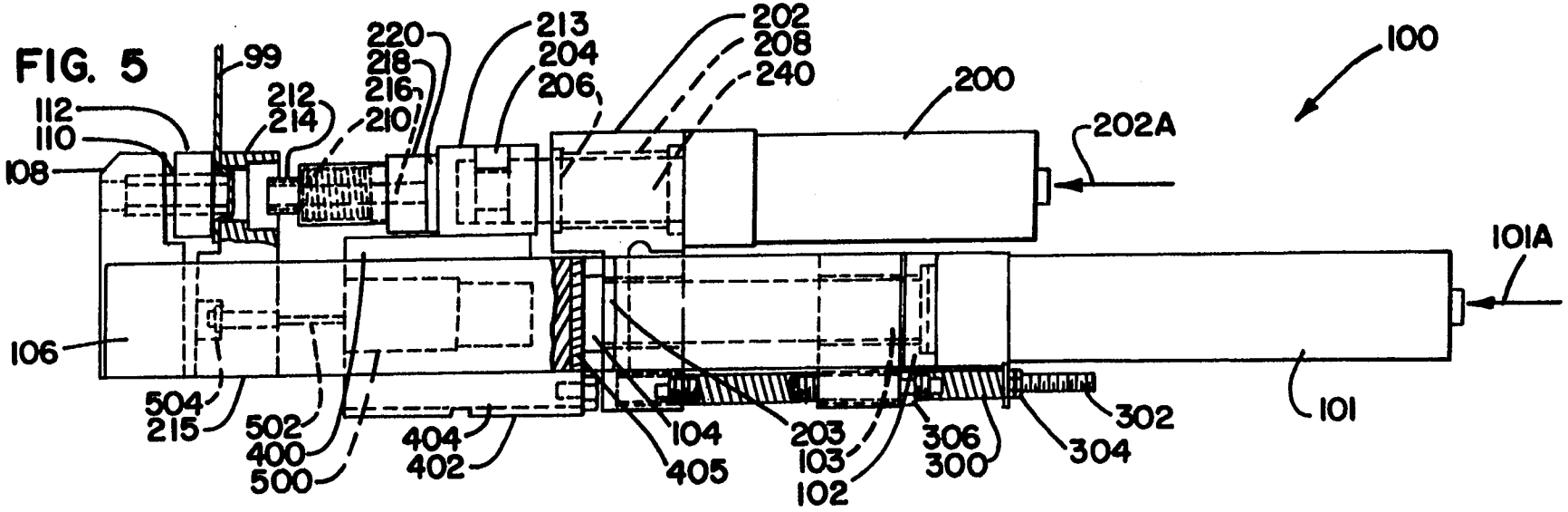
FIG. 5 is a side view of the apparatus and the workpiece formed to a net position.

As shown in FIG. 5, form punch 110 deforms workpiece 99 to a net position. The net position is determined by the distance in which form cylinder rod 103 extends out form cylinder 101. Thus, if form punch 110 is forming a pad, the height of the pad will vary depending on the initial location of workpiece 99 relative to form punch 110. The distance in the preferred embodiment is determined by the full extension of form cylinder rod 103. However, alternative methods of drawing workpiece 99 to a net position may be provided, including but not limited to, the use of servos to detect the distance of form cylinder rod 103 travel or limit switches, or stops contacted by anvil 108, which would trip limit switches to stop extension of cylinder rod 103.

Figure 6:
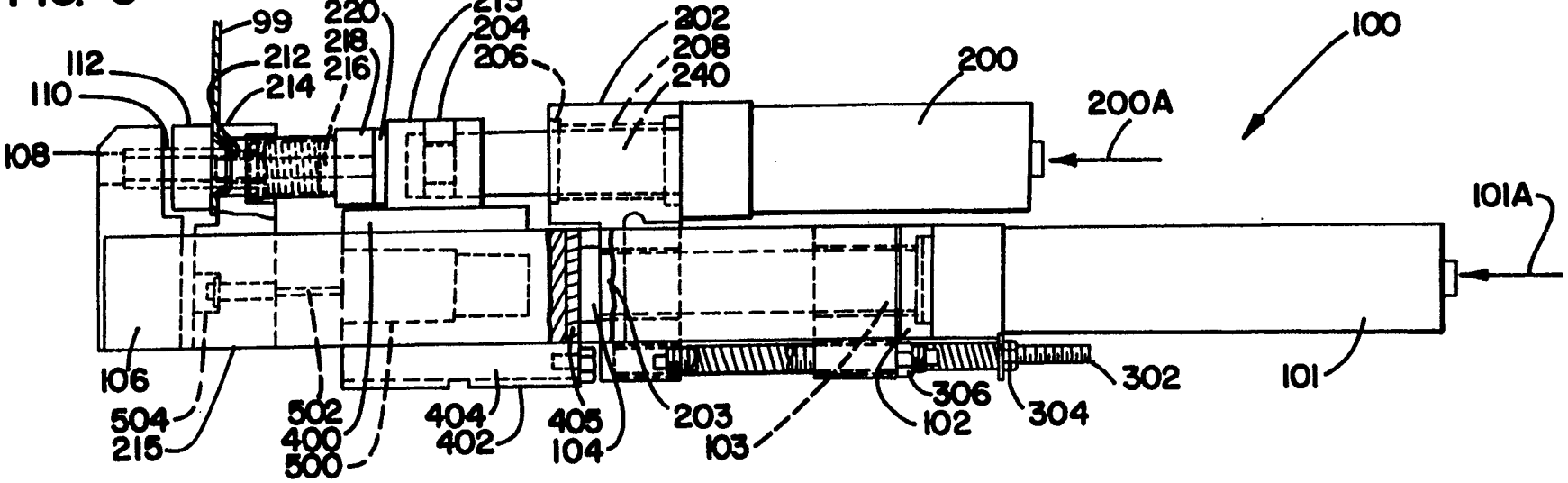
FIG. 6 is a side view of the apparatus with the punch of the inner assembly piercing the workpiece.

As shown in FIG. 6, pierce cylinder 200 then actuates, to drive punch retainer 2218 along gib plate 400 in a direction towards workpiece 99. Pierce cylinder 200 then forces pierce punch 216 through a spring 210 and through an aperture in form back-up 214 as well as an aperture in form punch 110 to pierce a hole in workpiece 99.

Piercing a hole in workpiece 99 provides a location with which structure may be mounted to the workpiece. For example, if workpiece 99 is a car pillar, form punch 110 operates to form a pad on which an outer panel (not shown) may be mounted. The outer panel would be mounted to the pad on the car pillar through the hole formed by pierce 216 by suitable means, a screw type fastener.

Pierce cylinder then retracts thus withdrawing pierce 216 from workpiece 99. A stripper 212 clamps workpiece 99 to form punch 110 as pierce punch 216 is withdrawn from workpiece 99.

Bullet head 104 of form cylinder rod 103 then disengages base block 404 and retracts towards form cylinder 101. During retraction, anvil 108 and form punch 110 move away from workpiece 99. Bullet head 104 then engages cylinder mounting rod extension 203 and pulls inner slide assembly 200A back towards its original position as shown in FIG. 1. As inner slide assembly 200A is drawn back towards its original position, one-way pilot valve (not shown) disengages so that the fluid in slave cylinder 500 may be expelled. Through drawing inner slide assembly 200A and pierce cylinder mounting block extension 203 back, equalization spring 300 is compressed. Form cylinder 101 draws form rod 103 back until stop shaft 306 contacts rest button 308, at which time form cylinder 101 disengages.

As one example, the cylinders of the present invention are from SAVAIR Incorporated located at 33200 Freeway Drive, St. Clair Shores, Mich. 48082 under the model numbers JJ-SQ and H18. Preferably, the entire construction is made from alloy steel, but in light duty applications, other materials may be substituted.

The present invention provides the benefits of forming a workpiece consistently to a net position. This consistent forming of a workpiece to a net position allows variations in the exact orientation of the workpiece between the anvil and form punch and the form back-up. For example, the workpiece may come in slightly left or slightly right of center, as shown by the phantom lines in FIG. 1.

In light of the above disclosure, it is recognized that the equalization spring in combination with the slave cylinder permit the form back-up to lock in position against the workpiece regardless of the initial position of the workpiece. Workpiece 99 regardless of its initial position relative to form punch 110 and form back-up 214 will be drawn out to a constant position relative to base block 404. The constant position permits interior parts to be slightly misaligned while any panels mounted thereon are completely aligned.

For example, as stated earlier, the present invention may be used to form what are known as pads on inner auto body components. These pads will be drawn out to a constant position in space. Ordinarily, the workpiece is attached to what is known in the art as a frame. Parts of the frame may not always be completely flush. The variations in the frame are caused by a variety of factors including material thickness or wear in the tools which are used to manufacture the frame components. These variations in the frame are corrected by drawing the parts associated with the frame to a net position. The net position in essence corrects, or makes flush the pads on which outer panels or additional parts may be mounted.

Additionally, because the invention permits limited use of electronic controls, the invention provides reliable service in the often greasy and dirty factory environment. The grease and dust in many factories cover electrical contacts and switches. This tends to cause these electronic components to fail, or to be unreliable. Forming a workpiece to a net position requires a reliable system, which the present invention provides.

Additionally, the present invention provides a compact system which may be positioned to form interior parts on a frame. The compact design is accomplished through the concepts discussed above.

Further, it is to be understood that even though numerous characteristics and advantages of the invention have been set forth in the foregoing description, together with details of the structure and function of the invention, the disclosure is illustrative only and changes may be made in detail, and especially in matters of shape, size and arrangement of parts wherein the principles of the invention the full extent indicated by the broad general meaning of the terms in which the pendent claims are expressed.

What is claimed is:

1. An apparatus to form a workpiece to a net position, which comprises:

a) a base;

b) an inner slide assembly mounted on said base for reciprocal movement, said inner slide assembly including a form back-up;

c) means for equalizing said form back-up against a workpiece;

d) an outer slide assembly mounted on said base for reciprocal movement, and said outer slide assembly including a forming piston having a forming cylinder and a rod extendable from said forming cylinder toward said base, said outer slide assembly further including a yoke having a distal end and a proximal end, said yoke mounted to said cylinder at its proximal end, said yoke having a die block mounted to its distal end; so that when said rod extends a predetermined amount from said cylinder and contacts said base, said die block moves towards said workpiece to deform said workpiece.

2. An apparatus as in claim 1 further comprising means for rigidly holding said form back-up against said workpiece.

3. An apparatus as in claim 2 wherein said means for rigidly holding includes a slave cylinder having a body and a rod mounted to said base at said body and operably mounted to said inner slide assembly at said rod.

4. An apparatus as in claim 3 wherein said slave cylinder includes a one way pilot valve for filling said cylinder.

5. An apparatus as in claim 1 wherein said inner slide assembly comprises:

a) a piercing piston having a pierce cylinder and a pierce rod extendable therefrom, said pierce rod having a distal end and a proximal end; said pierce rod having a punch positioned at said distal end of said pierce rod, said form back-up mounted to said pierce cylinder, and including an aperture sized to receive said die block, and said aperture sized to allow said punch to pierce said workpiece.

6. An apparatus as in claim 5 further including a stripper mounted at said distal end of said pierce rod and operable to restrain said workpiece when said punch is removed after said workpiece is pierced.

7. An apparatus as in claim 1 wherein said means for equalizing comprises a coil spring having a first end and a second end; said first end mounted to said base; said inner slide assembly including a mounting block extension having an aperture sized to receive said form rod, and said second end of said coil spring mounted to said mounting block extension of said inner slide assembly; so that when said rod extends towards said base, said spring pushes said mounting block extension and said inner slide assembly toward said workpiece.

8. An apparatus to form a workpiece comprising:

a) a base;

b) an outer slide assembly mounted on said base for reciprocal movement relative to said base; said outer slide assembly including a form operable to emboss a workpiece; said outer slide assembly including a form rod extendable toward said base;

c) an inner slide assembly mounted on said base for movement relative to said base, said inner slide assembly including a form back-up;

d) a coil spring having a first end and a second end; said first end mounted to said base; said inner slide assembly including a mounting block extension having an aperture sized to receive said form rod, and said second end of said coil spring mounted to said mounting block extension of said inner slide assembly; so that when said rod extends towards said base, said spring pushes said mounting block extension and said inner slide assembly toward said workpiece; and e) a slave cylinder having a slave rod extending therefrom, said slave cylinder being mounted to said base and said slave rod operably connected to said inner slide assembly; said slave cylinder including a one way valve, said slave cylinder being fillable through said one way valve so that when said form back-up contacts said workpiece said slave cylinder rigidly holds said form back-up against said workpiece.

9. An apparatus as in claim 8 wherein said outer slide assembly further comprises a form cylinder from which said form rod extends in a direction towards said base; an outer slide rail connecting said form cylinder to said form, so that when said form rod contacts said base said form moves toward said workpiece.

10. An apparatus as in claim 9 wherein a metallic plate is mounted on said base between said form rod and said base.

11. An apparatus as in claim 10 further comprising a stop shaft adjustably received in said mounting block extension of said inner slide assembly, and proximate said base so that said mounting block extension may be pushed away from said base.

12. An apparatus as in claim 8 wherein said inner slide assembly further comprises:

a pierce cylinder having a pierce rod extendable therefrom and a punch mounted to said pierce rod operable in piercing a hole through said workpiece.

13. An apparatus to form a workpiece to a net position, which comprises:

a) a base;

b) an outer slide assembly slidably received on said base and including a form cylinder having a form rod extending therefrom towards said base, said form rod having a bullet head; said outer assembly further including a yoke having a distal end and a proximal end, said proximal end mounted to said cylinder, said yoke further having a die block mounted at its distal end; and c) an inner slide assembly slidably received on said base and said inner slide assembly having a distal end and a proximal end and including a form back-up mounted at said distal end, and a mounting block extension positioned between said distal and said proximal ends of said inner slide assembly, said mounting block extension biased towards said bullet head of said form rod so that when said piston actuates said mounting block extension and inner slide move toward the workpiece until said form back-up contacts said workpiece; said inner slide assembly further including a pierce cylinder having a pierce rod extendible therefrom and operative in piercing said workpiece.

14. An apparatus as in claim 13 further comprising a hydraulic slave cylinder including a cylinder and a piston received within said cylinder, said cylinder mounted to said base, said slave cylinder including a one way valve, said slave cylinder being fillable through said one way valve when said inner slide moves toward said work-piece.

15. An apparatus as in claim 14 wherein said base further includes an aperture therethrough and said slave cylinder is mounted in said aperture.

16. An apparatus as in claim 14 wherein said slave cylinder is integrally formed with said base.

17. An apparatus as in claim 12 wherein said mounting block extension is biased against said bullet head by a coil spring having a first and a second end, said coiled spring attached to said base at said first end, and attached to said mounting block extension at said second end.

18. An apparatus as in claim 12 wherein said base includes a form pocket sized in receiving said form rod.

* * * * *